US012313299B2

(12) United States Patent
Branecky

(10) Patent No.: US 12,313,299 B2
(45) Date of Patent: May 27, 2025

(54) WATER HEATER WITH RESERVE CAPACITY, AND METHOD OF OPERATING THE SAME

(71) Applicant: A. O. SMITH CORPORATION, Mikwaukee, WI (US)

(72) Inventor: Brian T. Branecky, Oconomowoc, WI (US)

(73) Assignee: A. O. Smith Corporation, Milwaukee, WI (US)

( * ) Notice: Subject to any disclaimer, the term of this patent is extended or adjusted under 35 U.S.C. 154(b) by 0 days.

(21) Appl. No.: 17/854,512

(22) Filed: Jun. 30, 2022

(65) Prior Publication Data

US 2023/0011737 A1 Jan. 12, 2023

Related U.S. Application Data

(60) Provisional application No. 63/217,494, filed on Jul. 1, 2021.

(51) Int. Cl.

| | |
|---|---|
| ***F24H 15/172*** | (2022.01) |
| ***F24H 9/20*** | (2022.01) |
| ***F24H 15/152*** | (2022.01) |
| ***F24H 15/156*** | (2022.01) |
| ***F24H 15/238*** | (2022.01) |

(Continued)

(52) U.S. Cl.

CPC ..... *F24H 15/172* (2022.01); *F24H 9/2007* (2013.01); *F24H 15/152* (2022.01); *F24H 15/156* (2022.01); *F24H 15/238* (2022.01); *F24H 15/269* (2022.01);

(Continued)

(58) Field of Classification Search

CPC ..... F24H 15/172

See application file for complete search history.

(56) References Cited

U.S. PATENT DOCUMENTS

| | | | | |
|---|---|---|---|---|
| 2010/0004790 | A1* | 1/2010 | Harbin, III | F24H 15/464 709/219 |
| 2013/0213069 | A1* | 8/2013 | Elliott | F25B 30/00 62/238.7 |
| 2014/0321839 | A1* | 10/2014 | Armstrong | F24H 15/254 392/498 |

FOREIGN PATENT DOCUMENTS

| | | | |
|---|---|---|---|
| JP | 2020076527 A | * | 5/2020 |
| KR | 20130120868 A | * | 11/2013 |

OTHER PUBLICATIONS

KR-20130120868-A English translation (Year: 2013).*
JP-2020076527-A English translation (Year: 2020).*
EPRI, peak load shifting by thermal energy storage (Year: 2011).*

* cited by examiner

*Primary Examiner* — Steven S Anderson, II
*Assistant Examiner* — Kurt J Wolford
(74) *Attorney, Agent, or Firm* — Michael Best & Friedrich LLP

(57) ABSTRACT

A method of operating a water heater, the method including determining a predicted variation of a hot water consumption rate variable over a future time period and calculating a total required operating time of the water heater over that time period. The method further includes determining multiple possible operating profiles of the water heater that provide the total required operating time, and calculating a minimum hot water reserve for each profile. One of the profiles is selected based at least partially on that profile providing a minimum hot water reserve that is not less than a predetermined desired reserve capacity and the water (Continued)

heater is operated over the time period using that profile. The selected profile may be the profile that is calculated to have the lowest operational cost.

13 Claims, 7 Drawing Sheets

(51) Int. Cl.
*F24H 15/269* (2022.01)
*F24H 15/335* (2022.01)
*F24H 15/355* (2022.01)
*F24H 15/429* (2022.01)

(52) U.S. Cl.
CPC ..... *F24H 15/335* (2022.01); *F24H 15/355* (2022.01); *F24H 15/429* (2022.01)

HOUR

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 |
|---|---|---|---|---|---|---|---|---|---|---|---|---|---|---|---|---|---|---|---|---|---|---|---|---|
| PROFILE 1 | Y | Y | Y | Y | Y | Y | Y | Y | Y | N | N | N | N | N | N | N | N | N | N | N | N | N | N | N |
| PROFILE 2 | Y | Y | Y | Y | Y | Y | Y | Y | N | Y | N | N | N | N | N | N | N | N | N | N | N | N | N | N |
| PROFILE 3 | Y | Y | Y | Y | Y | Y | Y | Y | N | N | Y | N | N | N | N | N | N | N | N | N | N | N | N | N |
| PROFILE 4 | Y | Y | Y | Y | Y | Y | Y | Y | N | N | N | Y | N | N | N | N | N | N | N | N | N | N | N | N |
| PROFILE 5 | Y | Y | Y | Y | Y | Y | Y | Y | N | N | N | N | Y | N | N | N | N | N | N | N | N | N | N | N |
| PROFILE 6 | Y | Y | Y | Y | Y | Y | Y | Y | N | N | N | N | N | Y | N | N | N | N | N | N | N | N | N | N |
| ... | | | | | | | | | | | | | | | | | | | | | | | | |
| PROFILE n | N | N | N | N | N | N | N | N | N | N | N | N | N | N | N | Y | Y | Y | Y | Y | Y | Y | Y | Y |

600

WATER HEATER WITH RESERVE CAPACITY, AND METHOD OF OPERATING THE SAME

CROSS-REFERENCE TO RELATED APPLICATIONS

This application claims priority to U.S. provisional patent application No. 63/217,494, filed on Jul. 1, 2021, the entire contents of which are hereby incorporated by reference in their entirety.

BACKGROUND

Tank-type water heaters typically operate by storing heated water in a tank so that a sufficient quantity of hot water will be available on demand. The tank volume is typically sized such that the highest volume draw of hot water that is expected to occur at any given time can be accommodated. As hot water is drawn from the top of the tank, it is replaced by cold water at the bottom. The cold water is then heated, either within the tank or through an externally located heat source. In many cases, however, at least some of the hot water stored within the tank may not be needed for some time.

In some regions, the cost of power (for example, electrical power) is varied such that the cost per unit of power is increased at times of high loading on the power distribution grid, and decreased at times of lower loading on the power distribution grid, in order to encourage the shifting of power consumption to times of lower loading when possible. Times of high and low loading tend to be predictable, and at least some power utilities are able to forecast the variation in the cost of power for a future time period.

When some of the hot water stored within the tank of a water heater is drawn during times when the cost of power is high, it may be desirable to delay heating the cold replacement water until a later time, when the cost to do so will be lower. However, such a delay could lead to an insufficient quantity of hot water to meet subsequent draws. This is especially true for water heaters having a lower heating rate, such as heat pump water heaters, which require longer periods of time to heat a given volume of water.

SUMMARY

The present invention optimizes the operation of a tank-style water heater by allowing for the selection of a desired reserve capacity of hot water in excess of expected hot water demand. The desired reserve capacity is a predetermined volume, less than the full volume of the tank, that will be available to satisfy demands for hot water above and beyond an expected hot water demand profile.

According to an embodiment of the invention, a method of operating a water heater. The method includes determining a predicted variation of a hot water consumption rate variable over a future time period and calculating a total required operating time of the water heater over that time period. The method further includes determining multiple possible operating profiles of the water heater that provide the total required operating time and calculating a minimum hot water reserve for each profile. One of the profiles is selected based at least partially on that profile providing a minimum hot water reserve that is not less than a predetermined desired reserve capacity, and the water heater is operated over the time period using that profile.

The hot water consumption rate variable can be a flow rate, such as a volumetric flow rate or a mass flow rate. The predicted variation of the variable can be based on historical data, such as a historical variation of the variable that is monitored by the water heater. Alternatively, the predicted variation of the variable can be based on information provided by a user of the water heater. In some embodiments, the predicted variation can be one of several predefined variation profiles.

In some embodiments, the time period is a twenty-four hour time period. In other embodiments, the time period is greater or less than a twenty-four hour period.

In some embodiments, the predetermined desired reserve capacity is selected by a user of the water heater from multiple selectable reserve capacities. In other embodiments, the predetermined desired reserve capacity is directly entered by the user. In still other embodiments, the predetermined desired reserve capacity is calculated by the water heater based on other information provided by the user.

In at least some embodiments, the method includes receiving a forecasted variation of a variable related to the cost of operating the water heater over the future time period. In some such embodiments, the variable is a price of electrical power. The method can further include calculating a total cost of operating the water heater over that time period for at least some of the possible operating profiles using that forecasted variation. In some such embodiments, the selected profile is selected based at least partially on the calculated total cost of operating the water heater.

In some embodiments, the operating profile is selected by determining a subset of the possible operating profiles, and selecting from that subset the operating profile having the lowest calculated total cost of operating the water heater over that time period. In at least some such embodiments, the subset includes those ones of the possible operating profiles that have a minimum hot water reserve that is not less than the predetermined desired reserve capacity.

According to another embodiment of the invention, a water heater includes a tank to store water, a recirculation loop coupled to the tank, and a controller. The recirculation loop has an inlet end arranged near a bottom end of the tank, and an outlet end arranged near a top end of the tank. A pump is arranged along the recirculation loop to circulate water in the tank from the inlet end to the outlet end, and a heating source is arranged along the recirculation loop to heat the water flowing through the recirculation loop. In some embodiments, the heating source is a condenser of a heat pump. In other embodiments the heating source is an electric heating element. In still other embodiments, the heating source includes a burner.

In at least some embodiments, the controller is configured to select a preferred operating profile from multiple possible operating profiles. Each of the possible operating profiles comprises activating and deactivating the pump and the heating source over select portions of a predetermined time period. The controller can be further configured to operate the heating source and the pump over the predetermined time period according to the preferred operating profile.

In at least some embodiments, the controller is configured to select the preferred operating profile by determining a predicted variation of a hot water consumption rate variable over a future time period, and calculating a total required operating time of the water heater over that time period. The controller can be configured to identify the possible operating profiles as those profiles that provide a total operating time that is equal to the total required operating time of the water heater over that time period. In at least some such embodiments, the controller can be configured to calculate a minimum hot water reserve over the predetermined time period for each one of the possible operating profiles using the predicted variation of the hot water consumption rate variable, and to select the preferred operating profile based at least partially on the calculated minimum hot water reserve being not less than a predetermined desired reserve capacity.

In some embodiments, the predetermined desired reserve capacity is selected by a user of the water heater from multiple selectable reserve capacities. In other embodiments, the predetermined desired reserve capacity is directly entered by the user. In still other embodiments, the predetermined desired reserve capacity is calculated by the water heater based on other information provided by the user.

In at least some embodiments, the controller is configured to receive forecasted electricity pricing information for the predetermined time period. The controller can be configured to select the preferred operating profile by calculating a total cost of operating the water heater over the future time period for at least some of the possible operating conditions, forming a subset of the possible operating profiles including those operating profiles with a calculated minimum hot water reserve that is not less than the predetermined desired reserve capacity, and identifying from that subset the operating profile that has the lowest calculated total cost of operating the water heater.

DETAILED DESCRIPTION

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
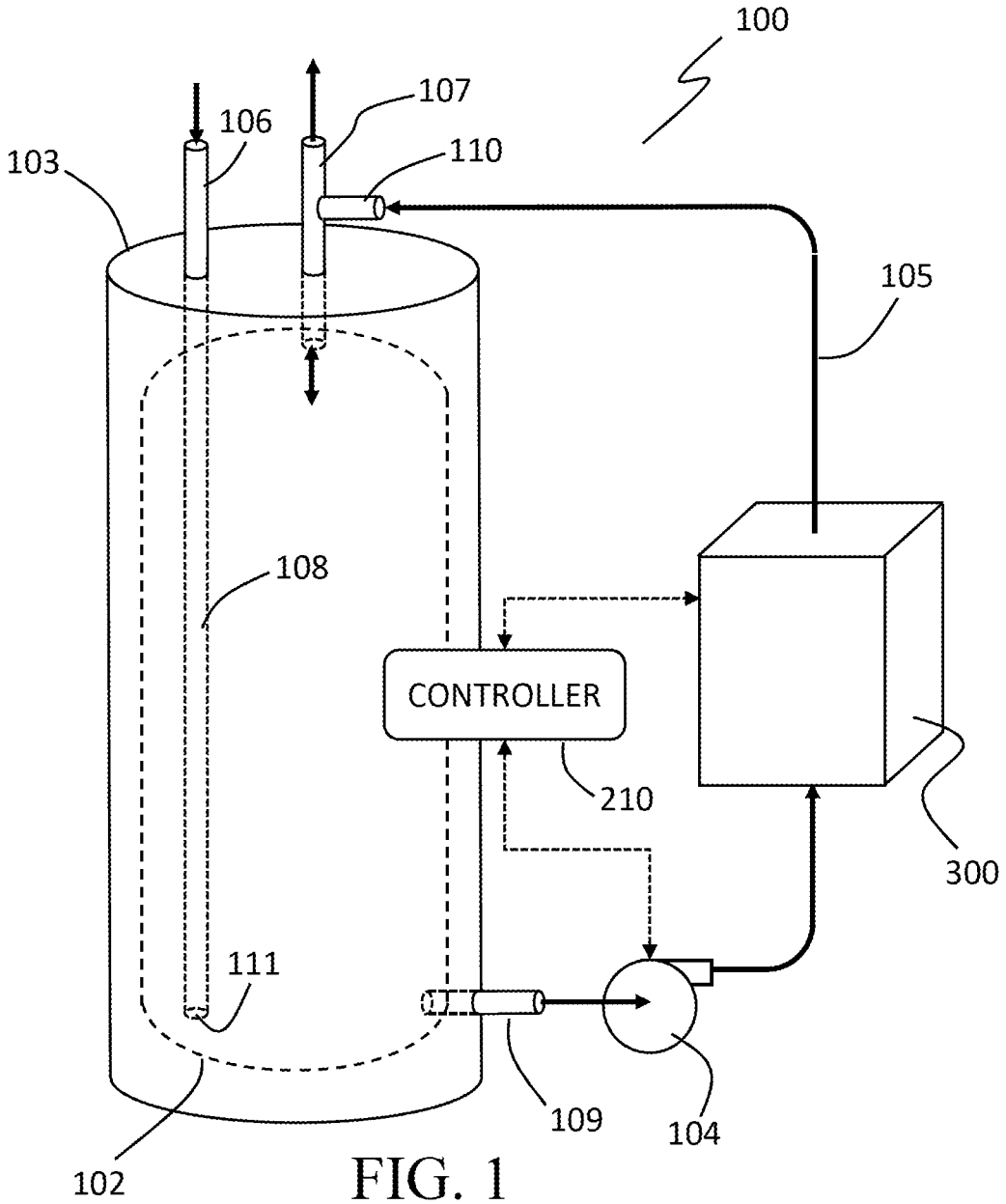
FIG. 1 is a schematic representation of a water heater according to an embodiment of the invention.

An exemplary embodiment of a water heater 100 according to some embodiments of the invention is depicted in schematic form in FIG. 1. The water heater 100 includes a hot water storage tank 102, which is arranged within an insulated outer shell 103. The tank 102 is preferably constructed of a pressure-resistant material such as steel, and can be internally lined with a coating (for example, a glass coating) to resist corrosion of the tank material by water contained within the tank 102. An inlet connection 106 and an outlet connection 107 both extend out of a top end of the outer shell 103, and extend into an inner volume of the tank 102. In the exemplary embodiment the tank 102 has an inner volume measuring 50 gallons, but in other embodiments the inner volume can be larger or smaller.

The inlet connection 106 and outlet connection 107 allow the water heater 100 to be connected into a water system of a residence, commercial building, or other structure. The inlet connection 106 is connected to a (generally cold) water supply portion of the water system, and the outlet connection 107 is connected to a hot water delivery portion of the water system. The outlet connection 107 preferably terminates within the tank 102 at or near the top end of the tank 102. In contrast, the inlet connection 106 preferably terminates at or near the bottom end of the tank 102, such as by way of a dip tube 108 that is joined to the inlet connection 106. Such an arrangement ensures that cold water entering the tank 102 through the inlet connection 106 is directed towards the bottom end of the tank 102, through an outlet end 111 of the dip tube 108. In alternative embodiments, the inlet connection 106 can be arranged to directly enter at or near the bottom end of the tank 102.

The water heater 100 further includes a recirculation loop 105 extending between an inlet end 109 of the recirculation loop 105 and an outlet end 110 of the recirculation loop 105. The inlet end 109 is arranged at or near the bottom end of the tank 102, while the outlet end 110 is arranged at a T-junction of the outlet connection 107. A pump 104 and a heating source 300 are arranged along the recirculation loop 105 between the inlet end 109 and the outlet end 110.

The water heater 100 further includes a controller 210 that form a portion of a control system 200 of the water heater 100. As will be described in further detail, the controller 210 is communicatively coupled to the pump 104 and the heating source 300 so as to be able to control those devices in order to heat water in the tank 102. When activated by the controller 210, the pump 104 draws water from the bottom of the tank 102 through the inlet end 109, and circulates that water through the recirculation loop 105 to the outlet end 110. When the heating source 300 is also activated by the controller 210, the water that is directed through the recirculation loop 105 is heated as it passes through the heating source 300. In the case where hot water is not simultaneously demanded via the hot water delivery system, the water flowing through the recirculation loop 105 is returned into the tank 102 at or near the top end. In the case where hot water is simultaneously demanded via the hot water delivery system, some or all of the water flowing through the recirculation loop 105 is directed to the hot water delivery system to satisfy the demand. If, in such cases, the flow rate of water as provided by the pump 104 is less than the flow rate of water being drawn from the outlet connection 107, then additional water from the top of the tank 102 is also drawn out of the tank 102. If, on the other hand, the flow rate of water as provided by the pump 104 exceeds the flow rate of water being drawn from the outlet connection 107, then the excess water from the recirculation loop 105 is delivered into the top of the tank 102.

It should be understood that a demand for hot water need not be supplied by any water from the recirculation loop 105. If a draw of hot water occurs when the pump 104 is not operating, then the draw will be satisfied by water at the top of the tank 102. Whether the demand for hot water is satisfied solely by water at the top of the tank 102, solely by water from the recirculation loop 105, or by a combination of the two, the water will be replaced by cold water entering the tank 102 through the inlet connection 106.

By arranging the end 110 of the inlet connection 106 and the inlet end 109 of the recirculation loop 105 at or near the lower end of the tank 102, and by terminating the outlet connection 107 at or near the top end of the tank 102, temperature stratification of water in the tank 102 can be maintained or enhanced. This stratification results from the density of water being inversely related to temperature, such that colder water will sink to, or remain at, the bottom of the tank 102 and hotter water will rise to, or remain at, the top of the tank 102. The pump 104 therefore draws the coldest water into the recirculation loop 105. The heating source 300 is preferably controlled so as to heat the water flowing through the recirculation loop 105 to the setpoint temperature of the water heater 100, so that that water is returned to the top of the tank 102 at the desired storage temperature. As a result, hot water at a desirable temperature can be made available even when a portion of the tank 102 (specifically, a lower portion) contains unheated water.

Figure 3:
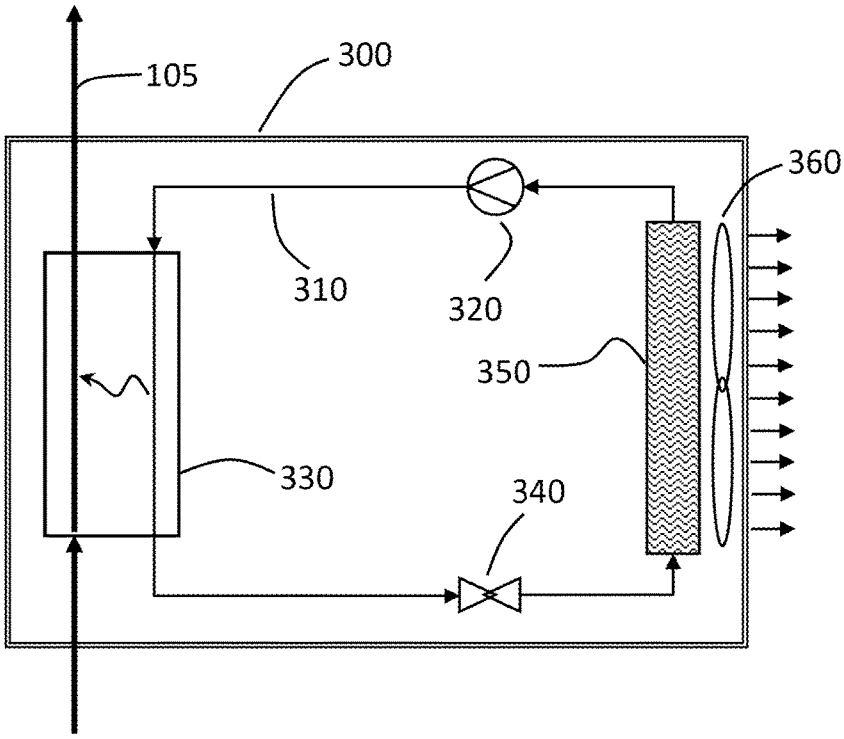
FIG. 3 is a schematic representation of a component of the water heater of FIG. 1.

An exemplary heating source 300 of the water heater 100 is depicted in schematic fashion in FIG. 3. The exemplary heating source 300 is an air-sourced heat pump, which operates a vapor compression cycle to transfer thermal energy from ambient air into the water flowing through the recirculation loop 105 by way of a refrigerant. The refrigerant is circulated through a loop 310 by a compressor 320. A high-pressure side of the loop 310 extends from the compressor 320 to an expansion device 340, while a low-pressure side of the loop 310 extends from the expansion device 340 back to the compressor 320.

During operation of the heating source 300, a fan 360 is used to draw ambient air over an evaporator 350, which is arranged along the low-pressure portion of the loop 310. Thermal energy from the air is transferred to the refrigerant in the evaporator 350, which enters the evaporator 350 as a low-pressure, low-quality liquid-vapor mixture, with a saturation temperature that is lower than the temperature of the air directed by the fan 360. The transferred thermal energy vaporizes the refrigerant, so that it exits the evaporator 350 as a saturated or slightly superheated vapor. The vapor refrigerant is compressed by the compressor 320 to a high-pressure vapor state, with a saturation temperature that is at least as high (and preferably somewhat higher than) the setpoint temperature of the water heater 100.

A condenser 330 is arranged along both the high-pressure side of the refrigerant loop 310 and the water recirculation loop 105. As the water and the refrigerant pass through the condenser 330, thermal energy from the hotter refrigerant is transferred to the cooler water, thereby simultaneously heating the water and cooling and condensing the refrigerant to a liquid (but still high pressure) state. The condensed refrigerant is then expanded back to the low-pressure, low-quality liquid-vapor mixture state in the expansion device 340 to complete the cycle.

It should be understood that not all components of the heating source 300 need be located within a common enclosure or in close proximity to the tank 102. For example, it may be preferable to locate at least the evaporator 350 in a separate location where the cooling of the air directed by the fan 360 is more desirable. Furthermore, the exemplary heating source 300 is but one possible version of a heating source of the water heater 100. Alternatively or in addition, the heating source 300 can take the form of a combustion system, electric heating elements, and the like.

In some alternative embodiments, the recirculation loop 105 can be eliminated by coupling the heat source 300 directly to the tank 102. For example, the heat source 300 can still include a heat pump system, but with the condenser 330 taking the form of one or more refrigerant coils that wrap around the tank 102 to heat the water within. As another example, the heat source 300 can include a burner with a heat exchange flue for the combustion gas arranged within the tank 102 to heat the water. As still another example, the heat source 300 can take the form of one or more electric resistance heating elements that extend into the inner volume of the tank 102 to heat the water. Such alternative heating sources can still achieve the desirable temperature stratification effects when appropriately integrated with the tank 102 by one of skill in the art.

Figure 2:
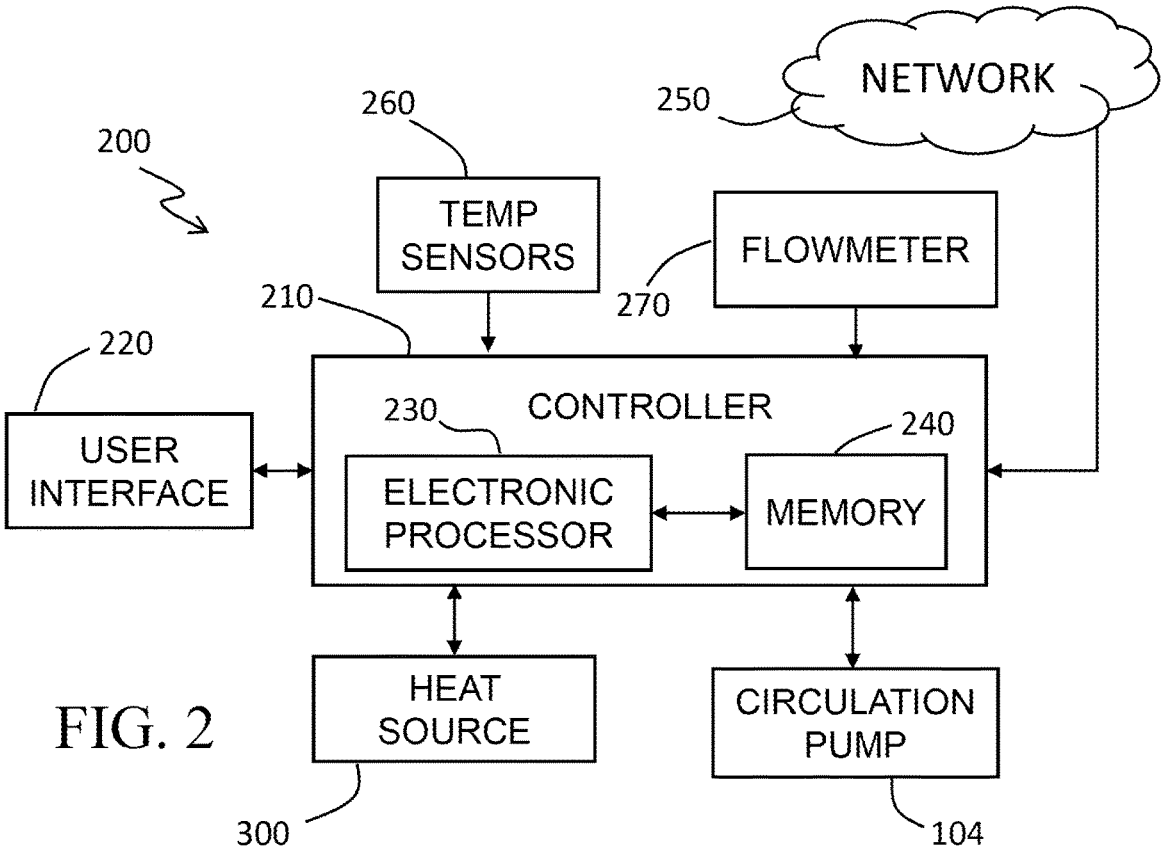
FIG. 2 is a schematic representation of a control system of the water heater of FIG. 1.

The control system 200 of the water heater 100 will now be described, with particular reference to FIG. 2. In some embodiments, the control system 200, or at least part of the control system 200, may be located remotely from the water heater 100. The control system 200 includes combinations of hardware and software that are operable to, among other things, control the operation of the water heater 100. As shown in FIG. 2, the control system 200 includes the controller 210 and a user interface 220. The controller 210 includes electrical and electronic components that provide power, operational control, and protection to components and modules of the water heater 100. For example, the controller 210 includes, among other things, an electronic processor 230 (e.g., a microprocessor, a microcontroller, or another suitable programmable device) and a memory 240. As described previously, the controller 210 is in communication with the heat source 300 and the pump 104 and controls the operation of those devices.

The memory 240 includes, for example, a program storage area and a data storage area. In some constructions, the memory 240 can include storage space in the cloud. The program storage area and the data storage area can include combinations of different types of memory, such as read-only memory ("ROM"), random access memory ("RAM") (e.g., dynamic RAM ["DRAM"], synchronous DRAM ["SDRAM"], etc.), electrically erasable programmable read-only memory ("EEPROM"), flash memory, a hard disk, an SD card, or other suitable magnetic, optical, physical, or electronic memory devices.

With continued reference to FIG. 2, the electronic processor 230 is connected to the memory 240 and executes software instructions that are capable of being stored in RAM (e.g., during execution), ROM (e.g., on a generally permanent basis), or another non-transitory computer readable medium such as another memory or a disc. Software included in the implementation of the water heater 100 can be stored in the memory 240 of the controller 210. The software can include, for example, firmware, one or more applications, program data, filters, rules, one or more program modules, and other executable instructions. The controller 210 retrieves from memory 240 and executes, among other things, instructions related to the control processes and methods described herein. In other constructions, the controller 210 includes additional, fewer, or different components.

The user interface 220 includes a combination of digital and analog input or output devices required to achieve a desired level of control and monitoring for the water heater 100. For example, in some embodiments the user interface 220 includes a display (e.g., a primary display, a secondary display, etc.) and input devices such as touch-screen displays, knobs, dials, switches, buttons, etc. The display can, for example, be a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. In other embodiments, the user interface 220 can include a smartphone running an application configured to communicate with the control system 200.

The user interface 220 can be configured to display conditions or data associated with the water heater 100 in real-time or substantially real-time. For example, the user interface 220 can be configured to display historical operational data of the water heater 100, such as water usage history, on and off times for the heating source 300, electrical consumption data, etc. In some implementations, the user interface 220 is controlled in conjunction with the one or more indicators (e.g., LEDs, speakers, etc.) to provide visual or auditory indications of the status or condition of the water heater 100. The user interface 220 can also be used to set certain parameters that will govern the operation of the water heater 100, as will be described.

As further shown in FIG. 2, the controller 210 is also in communication with a network 250, such as, for example, a WLAN, Wi-Fi network, Internet, and the like. As will be described, the controller 210 is configured to receive information from the network 250 in order to optimize the operation of the water heater 100.

One or more temperature sensors 260 and a flowmeter 270 are optionally included in the control system 200. The flowmeter 270, if present, can be installed within the water system at (or upstream of) the inlet connection 106, or at (or downstream of) the outlet connection 107, and can provide the controller 210 with data about the amount, duration, frequency, etc. of the hot water demand. The temperature sensors 260, if present, can include one or more of a water inlet temperature sensor (located, for example, at the inlet connection 106), a water outlet temperature sensor (located, for example, at the outlet connection 107), and tank temperature sensors (for example, sensors 261, 262, 263, 264, and 265, shown in FIG. 4).

The controller 210 stores in the memory 240 one or more expected hot water usage profiles (i.e. predicted variation profiles) over a future time period, such as for example a daily usage profile. The expected usage profile can be directly entered by a user via the user interface, can be selected as one of several pre-programmed usage profiles, can be a derived fully or partially from historical usage data, or can otherwise be provided to the controller 210. In at least some embodiments, the expected usage profile can be generated using responses that the user enters through the user interface 220 to questions that are posed through that user interface. By way of example, such questions can be directed to determining the number of residents in the dwelling, the average time and duration of showers, habits related to dishwashing, laundry, and other activities that consume large amounts of hot water, etc. The hot water usage profiles stored in the memory 240 can include a single profile to be used for each day, or different profiles for different days, such as one profile for weekdays and another profile for weekends, or a different profile for each day of the week, for example.

It should be understood that the actual hot water usage will in most cases vary at least somewhat from the expected hot water usage profile, due to (for example) unforeseen draws of hot water that occur during the day with unpredictable frequency. It can therefore be desirable to operate the water heater 100 in such a way that there is an additional reserve of hot water above and beyond the expected hot water usage profile, so that the unpredictable draws of hot water can be met. The controller 210 stores, in the memory 240, a desired reserve capacity (abbreviated at times herein as RC). The desired reserve capacity can be expressed as a volume of water that is less than the total inner volume of the tank 102. For example, the desired reserve capacity can be 10 gallons, 20 gallons, etc. In some cases, as will be described hereafter, the desired reserve capacity can be set to zero.

In at least some embodiments, the desired reserve capacity is directly entered by a user via the user interface, or is selected by the user as one of several pre-programmed reserve capacities. In other embodiments, the desired reserve capacity can be determined using responses that the user enters through the user interface 220 to questions that are posed through that user interface, those questions generally relating to the potential frequency and volume of hot water draws other than the ones used to generate the expected hot water usage profile. In at least some embodiments, the desired reserve capacity can be adjusted based on modes that the user selects. For example, when the number of occupants of the dwelling will temporarily be increased, the water heater 100 can be set to a "guest mode", which will result in an increased desired reserve capacity, and when the dwelling will be temperately vacant or at lower occupancy, the water heater 100 can be set to a "vacation mode", which will result in a decreased desired reserve capacity. The desired reserve capacity can also vary from day to day, for example based on the day of the week.

Figures 5, 6:
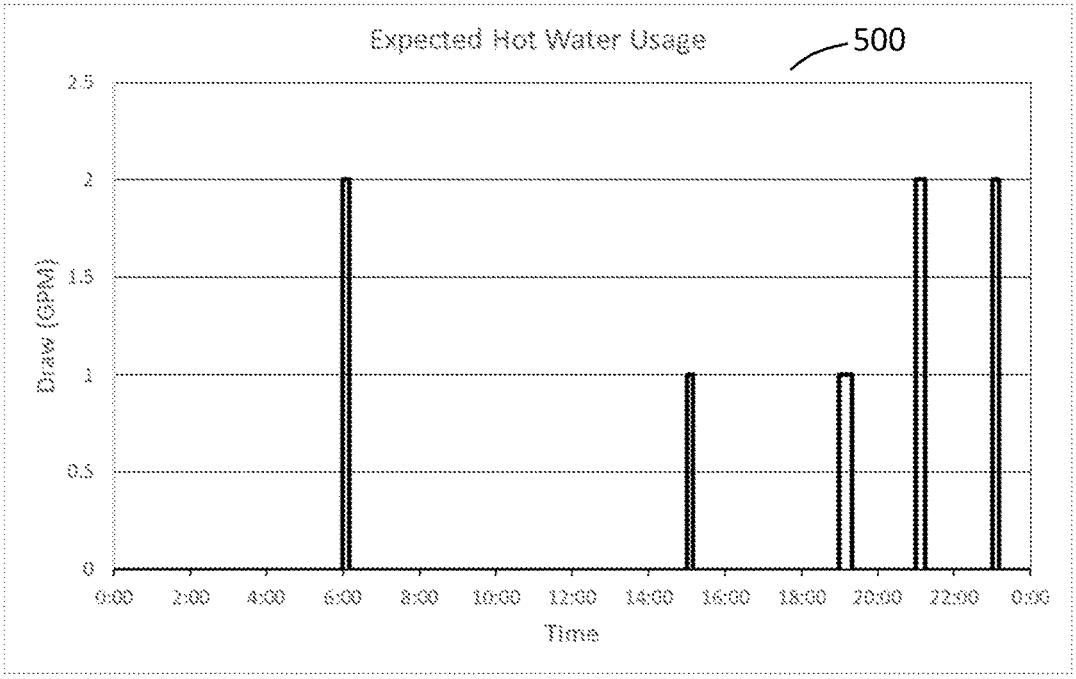
FIG. 5 is a graph of expected hot water usage over a future time period, as used in some embodiments of the invention.
FIG. 6 is a portion of an exemplary table of possible operating patterns of a water heater, as used in some embodiments of the invention.

An exemplary expected hot water usage profile is presented in tabular form below, and as graph 500 in FIG. 5. The usage profile is quantified by hot water draw amounts (in gallons or gallons per minute), times of day that the draws occur, and durations (in minutes) of each draw. Examples provided herein of methods by which the controller 210 optimizes the performance of the water heater 100 will make use of the exemplary expected hot water usage profile 500. It should be understood that the number of draws, the duration of each draw, and the time of each draw can vary in different implementations of the invention.

| DRAW # | DRAW [GAL] | TIME | DURATION [MIN] | DRAW [GPM] |
|---|---|---|---|---|
| 1 | 20 | 6:00 AM | 10 | 2 |
| 2 | 10 | 3:00 PM | 10 | 1 |
| 3 | 20 | 7:00 PM | 20 | 1 |

-continued

| DRAW # | DRAW [GAL] | TIME | DURATION [MIN] | DRAW [GPM] |
|---|---|---|---|---|
| 4 | 30 | 9:00 PM | 15 | 2 |
| 5 | 10 | 11:00 PM | 10 | 1 |

Figure 11:
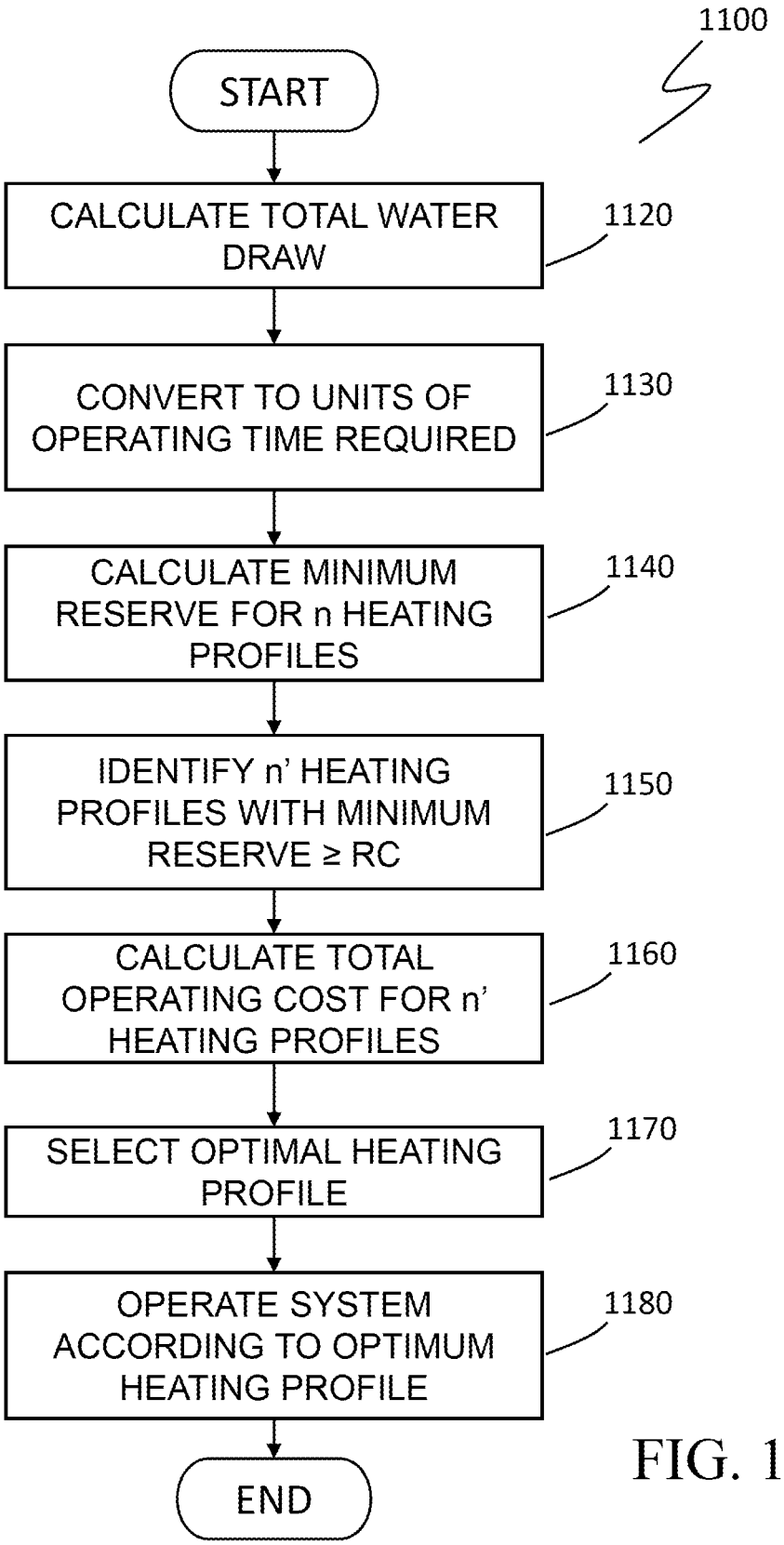
FIG. 11 is a flowchart of a process according to some embodiments of the invention.

The controller 210 uses the expected hot water usage profile to determine an optimal operation of the water heater 100 during the future time period (e.g. the next day), as will be described with specific reference to FIG. 11. The controller performs a process 1100 on a repeated cycle. The frequency with which the cycle operates is preferably the same as the length of the future time period (e.g. daily).

In step 1120, the controller 210 uses the expected hot water usage profile to calculate a variable relating to a hot water consumption rate over a future time period. The hot water consumption rate variable may be, for example, a flow rate, such as a volumetric flow rate or a mass flow rate. The hot water consumption rate is referred to herein as a total expected hot water demand/draw. The future time period, as described in the present example, may be the following day. The controller 210 calculates the total expected hot water draw as the sum of the separate draws. Using the exemplary data of graph 500, the total hot water draw is 90 gallons.

Next, in step 1130, the controller 210 converts this total water draw into the total amount of operating time of the heating source 300 that will be required to meet that total hot water demand over the future time period using the expected hot water usage profile. This conversion is achieved using the following formula:

$$t = \frac{V * C_v * (T_{out} - T_{in})}{Q}$$

where t is the operating time required, V is the volume of hot water to be heated (e.g. 90 gallons), $C_v$ is the volumetric specific heat capacity of water (e.g. 8.3 BTU/gallon/° F.), $T_{out}$ is the setpoint temperature of the hot water tank 102 (e.g. 140° F.), $T_{in}$ is the inlet water temperature (e.g. 52° F.), and Q is the heating capacity of the heating source 300 (e.g. 7300 BTU/hr). Using those exemplary values, the time t required to heat the total expected draw of hot water is approximately nine hours. The inlet water temperature can be a measured value that is provided to the controller 210 by one of the temperature sensors 260, but can also be a preprogrammed temperature stored in the memory 240.

Continuing to step 1140, the controller 210 determines a number of heating profiles that can provide the required operating time t. As shown in the table 600 (FIG. 6), the various heating profiles cover all of the possible combinations of operating times when the future time period (in the exemplary case, 24 hours) is discretized into blocks of time (in the exemplary case, one hour increments). The number (n) of possible heating profiles can therefore be calculated as:

$$n = \frac{x!}{(x-t)! * t!}$$

where x is the number of discrete time periods. For the exemplary case, where x=24 and t=9, there are n=1,307,504 possible heating profiles.

Within step 1140, the controller calculates a minimum reserve of hot water throughout the entire future time period for each of the n cases, using a stratified water heater model and the expected hot water usage profile 500. The stratified water heater model calculates the amount of hot water in the tank 102 in each discrete time period (i.e. the hot water reserve at that time period), taking into account the volume of hot water drawn from the tank 102 at specific time and flow rates according to the hot water usage profile 500, and the volume of cold water removed from the bottom of the tank 102 into the recirculation loop 105 and returned to the top of the tank 102 as hot water according to the heating profile. For each of the n possible heating profiles, the minimum reserve will be the lowest reserve value of any of the x discrete time periods.

Continuing on to step 1150, the controller 210 next identifies a subset n' of the n heating profiles, the subset n' comprising all of the heating profiles where the minimum reserve is greater than or equal to the desired reserve capacity RC. In some cases, there may not be any of the n heating profiles that have such a minimum reserve, in which case the controller can adjust the value of RC to be incrementally lower until there is at least one profile that meets the requirements.

Figure 7:
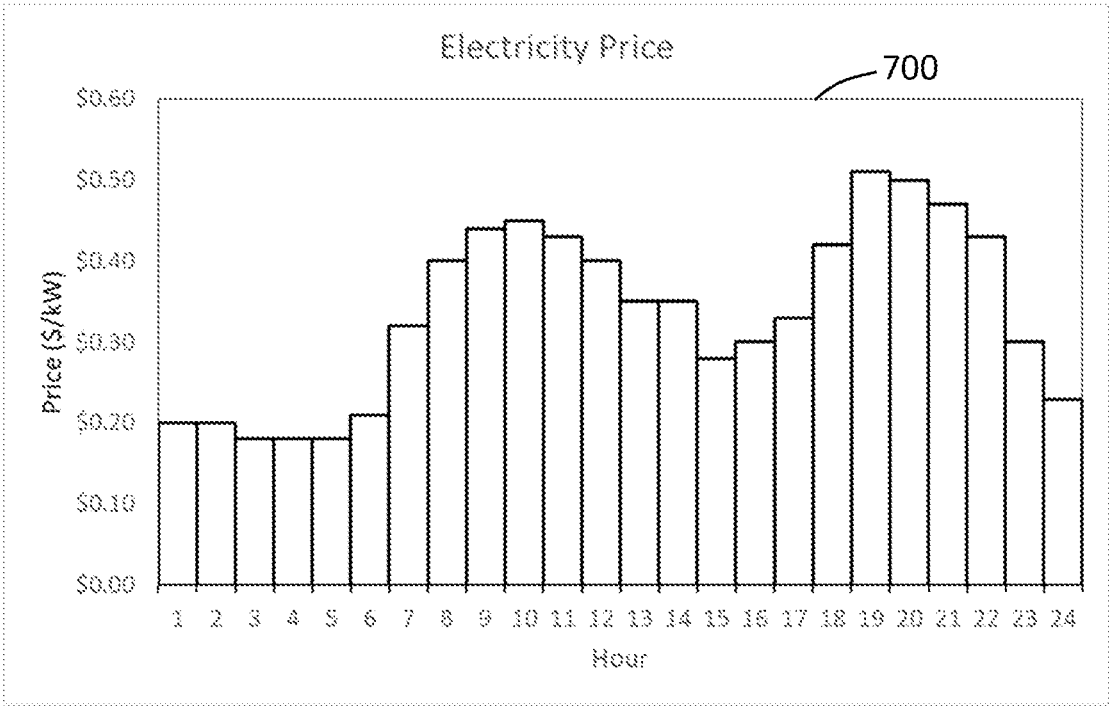
FIG. 7 is a graph of forecasted electricity pricing over a future time period, as used in some embodiments of the invention.

In step 1160, the controller 210 next calculates a total operating cost for each of the n' heating profiles. This operating cost can be based on a constant cost of fuel or electricity to be used by the heating source 300, or can be based on a time-varying cost of fuel or electricity. FIG. 7 illustrates an exemplary varying electricity cost over the future time period, with the price of electricity varying on an hourly basis. It should be understood, however, that in other cases the price of electricity can vary with greater or lesser frequency. In the exemplary embodiment, the controller 210 receives the data 700 as a forecasted variation relating to a cost of operating the water heater 100 (for example, an electrical power price) for the following day from the network 250. The data 700 can, for example, be provided by the electricity utility, which may vary the price of electricity throughout the day so that the price is higher at times of peak demand and lower at times of lesser demand.

Returning to FIG. 11, at step 1170 the controller 210 selects an optimal heating profile from the subset of n' profiles. The optimal heating profile is, for example, the heating profile that provides a hot water reserve throughout the entire day that is at least equal to the desired reserve capacity and that requires the lowest operating cost. As another example, the optimal heating profile may be one of several heating profiles, all having an equivalent or nearly equivalent operating cost, with the highest reserve capacity. In some instances, such as where the cost of electricity is constant, the optimal heating profile may be the profile that has the lowest minimum hot water reserve but at least the desired reserve capacity. It should be understood that the criteria used to select the optimal heating profile may vary based on different relative weightings of operating cost and reserve capacity.

Figure 8:
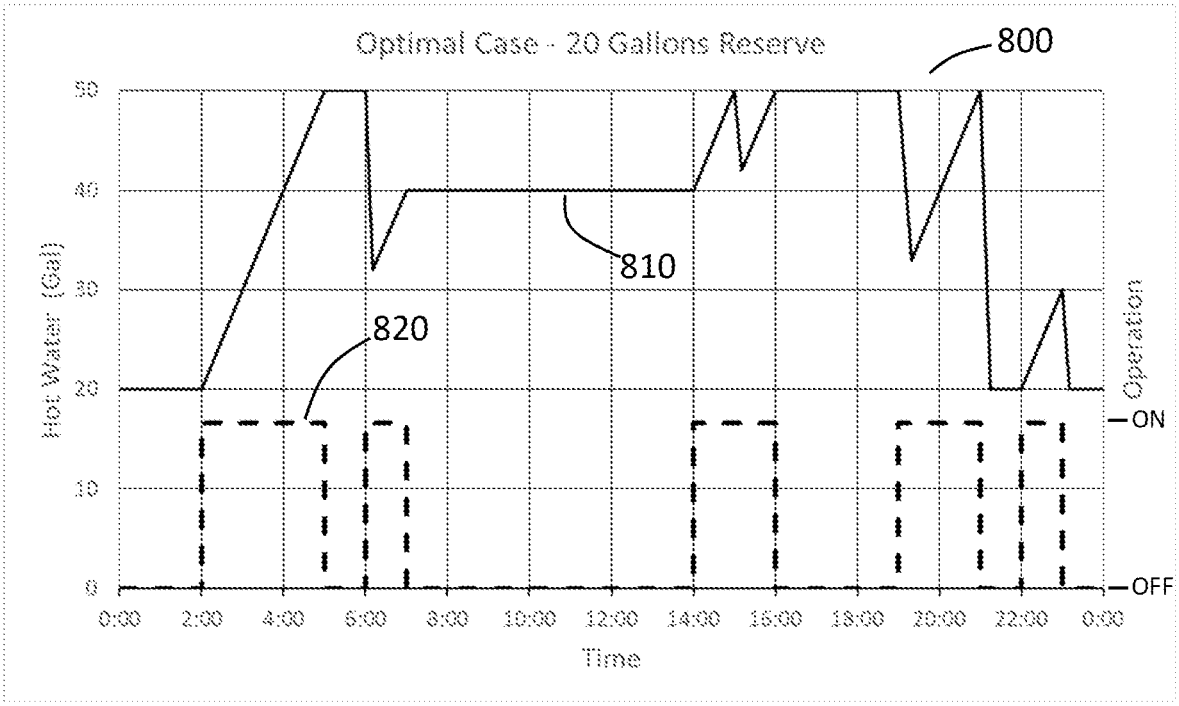
FIG. 8 is a first graph of optimized heat source utilization and hot water storage over time, according to some embodiments of the invention.

FIG. 8 is a graph 800 depicting the selected optimal operating profile and resulting hot water reserve in one exemplary embodiment, as calculated by the controller 210, using the expected hot water usage profile 500, the forecasted electricity price data 700, and a desired reserve capacity of 20 gallons. The dashed line 820 depicts the selected optimal operating profile, and the solid line 810 depicts the resulting calculated reserve of hot water in the tank 102 throughout the day. As can be seen in the graph, the water heater 100 begins the day with a hot water reserve equal to the desired reserve capacity of 20 gallons. The controller 210 takes advantage of the relatively low electricity pricing in the early morning hours, heating the water from 2 am to 5 am, which provides a full 50 gallons of hot water before the first expected draw at 6 am. As dictated by the expected hot water usage profile 500, the controller 210 assumes a 20 gallon draw of hot water from 6 am to 6:10 am, reducing the reserve down to near 30 gallons. Since the price of electricity is still fairly low at that time, the controller 210 also operates the heating source 300 from 6 am to 7 am, ending with 40 gallons of reserve at 7 am.

During the late morning and early afternoon hours the price of electricity is higher, and the optimal operating profile consequently does not provide any heating during that time. At 2 pm (when the price of electricity drops) the controller 210 again operates the water heater 100 for another two hours. During that heating event a 10 gallon draw is expected to occur (at 3 pm), but at 4 pm the reserve is back to 50 gallons. At 7 pm a large draw (20 gallons) of water is expected, leading to the controller 210 needing to operate the heating source 300 at that time for two hours, despite the high electricity price, to build the reserve back up to 50 gallons in anticipation of the 40 gallons of late-night draws. The water heater 100 is able to accommodate those draws (30 gallons at 9 pm and 10 gallons at 11 pm) with one additional hour of heating at 10 pm, and is calculated to maintain at least 20 gallons of reserve throughout the entire day.

Figure 9:
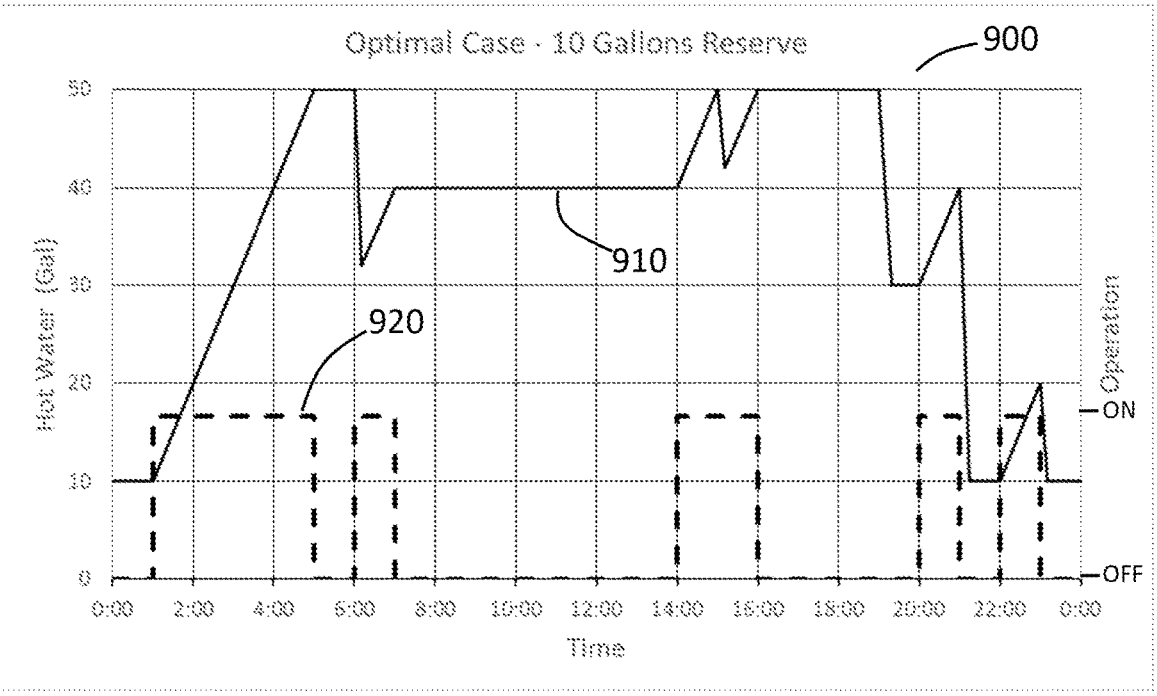
FIG. 9 is a second graph of optimized heat source utilization and hot water storage over time, according to some embodiments of the invention.

For comparison, the graph 900 (FIG. 9) depicts the optimal operating profile 920 and resulting hot water reserve 910 that the controller 210 calculates using a desired reserve capacity of 10 gallons. The operating profile 920 shifts one hour of the evening heating to the early morning, taking advantage of the lower electricity rate during the early morning hours. This can be done because the hot water reserve is allowed to drop 10 gallons lower than in the 20 gallon case, meaning that the last three draws of the day can be accommodated with less heating time at the end of the day.

Figure 10:
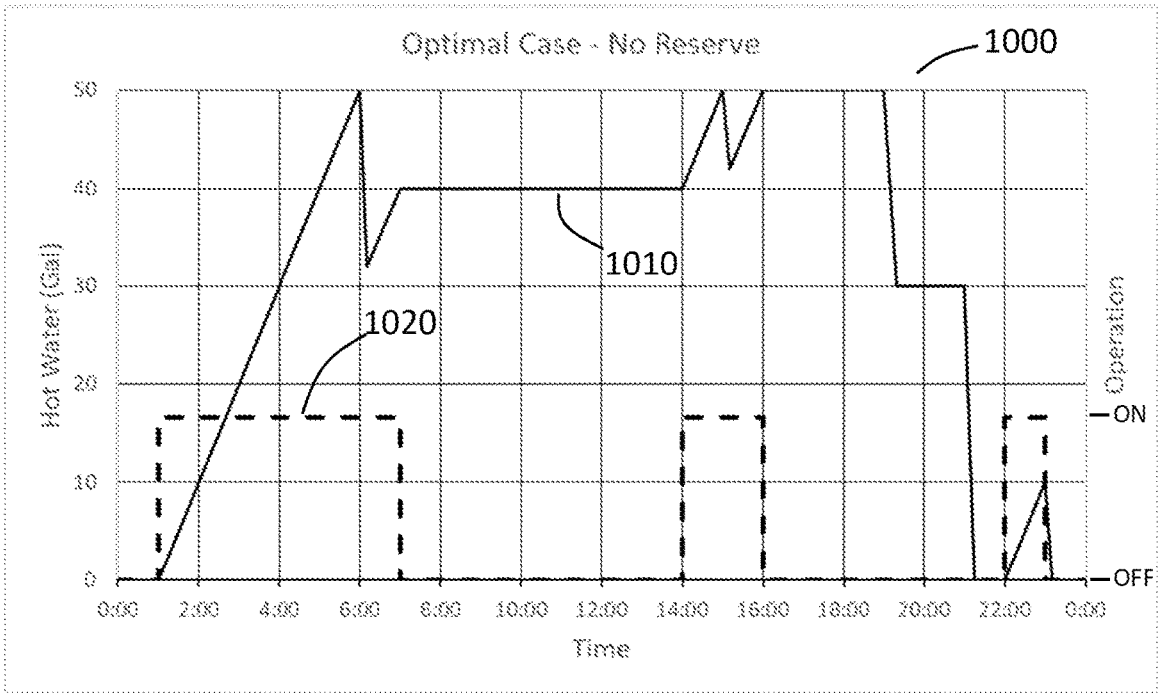
FIG. 10 is a third graph of optimized heat source utilization and hot water storage over time, according to some embodiments of the invention.

As yet another comparison, the graph 1000 (FIG. 10) depicts the optimal operating profile 1020 and resulting hot water reserve 1010 that the controller 210 calculates when there is no reserve planned for at all. For this case, yet another hour of night-time heating is shifted to the early morning hours. It should be noted that with this operating profile, any draws in excess of the expected draws profile can result in a lack of available hot water at some time during the day when hot water is demanded, since there is no reserve. For example, an additional draw of hot water during the day will result in the water heater 100 not being able to supply the full 30 gallon draw of hot water that is expected from 9 pm to 9:15 pm.

Once the optimal heating profile is selected by the controller 210 at step 1170, the process 1100 moves to step 1180, wherein the controller 210 operates the water heater 100 (including the heat source 300 and the pump 104) according to the selected heating profile. This operation occurs by the controller 210 comparing, on a repeating cycle (e.g. every minute, or more or less frequently), the current time of day to the selected operating profile to determine whether the heat source 300 and pump 104 should be turned on or off. This allows the water heater 100 to operate without requiring any temperature feedback from the tank 102 itself. However, in some embodiments the operation of the water heater 100 can be further improved using temperature feedback from the tank 102.

Once the water heater 100 has been operated over the length of the time period of the selected operating profile, the process 1100 ends. The process 1100 can be run cyclically, so that the process 1100 starts over again shortly or immediately after ending. The time period for the entire process 1100 can therefore be approximately equal to the time period of the hot water usage profile (for example, one day).

In some embodiments, the controller 210 can make adjustments to the operating profile during the time period of the hot water usage profile. By way of example, during the day the controller 210 can monitor the actual available reserve capacity within the tank 102 (by, for example, monitoring the water temperature at several points along the tank height) in order to compare that actual reserve capacity to the reserve capacity that is expected at that time of the day based on the selected operating profile and the expected hot water usage. In the event that the actual reserve capacity deviates from the expected reserve capacity, the controller 210 can adjust the remainder of the operating profile in response. As one example, the controller 210 can monitor the actual reserve capacity at pre-planned intervals, e.g. every hour. As another example, the controller 210 can monitor the water heater 100 to detect an unexpected draw (for example, by monitoring temperatures of flow rates) and can adjust the operating profile in response.

Figure 4:
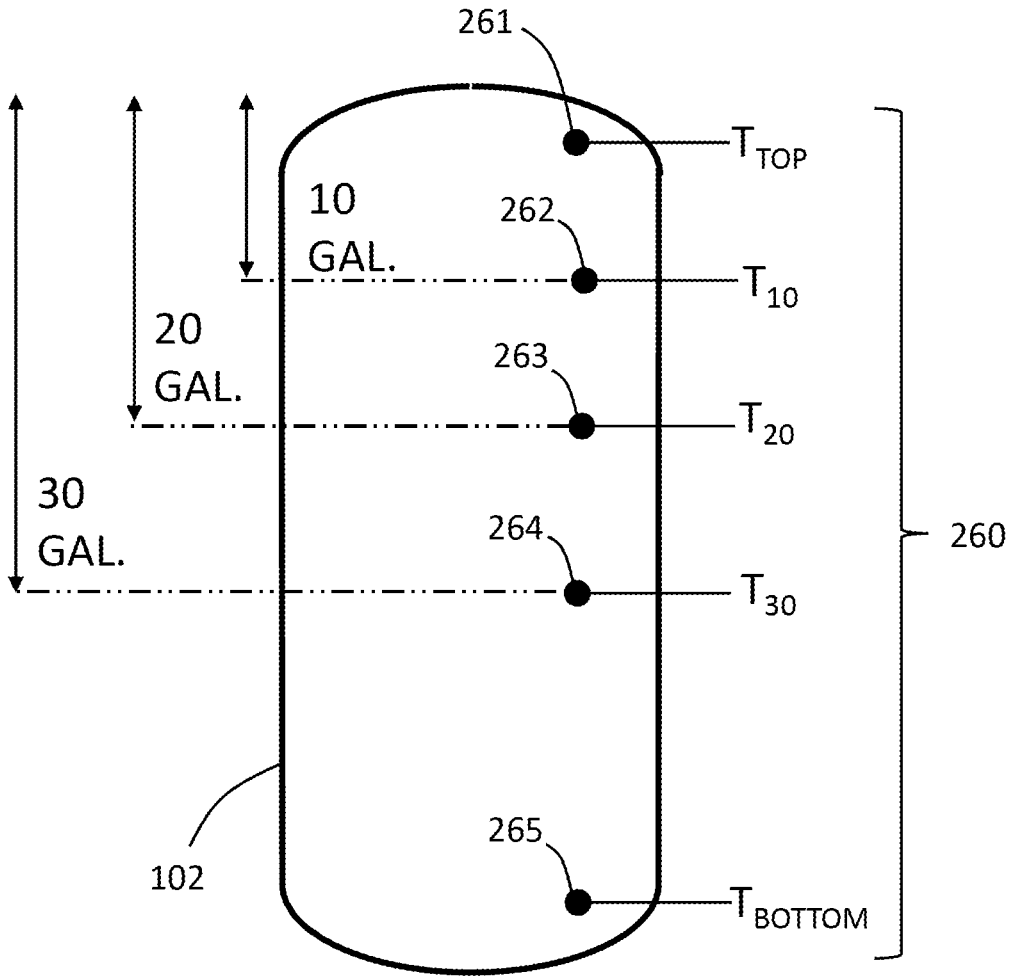
FIG. 4 is a diagram of temperature sensor locations along the height of a hot water tank, as used in some embodiments of the invention.

As depicted in FIG. 4, the tank 102 can optionally be equipped with temperature sensors 260 located at one or more positions along the height of the tank 102. For example, a temperature sensor 261 can be provided at or near the top of the tank 102 to measure a top tank temperature ($T_{TOP}$), and a temperature sensor 265 can be provided at or near the bottom of the tank 102 to measure a bottom tank temperature ($T_{BOTTOM}$). Another temperature sensor 262 can be provided at a location along the tank height above which the internal volume of the tank 102 is equal to 10 gallons to measure a temperature $T_{10}$. Similarly, additional sensors 263, 264 can be provided at locations corresponding to 20 and 30 gallons to measure temperatures $T_{20}$, $T_{30}$ respectively.

When such sensors are provided, the controller 210 can use temperature data received from those sensors in the performance of the process 1100. For example, in step 1130, the controller 210 may adjust the required units of operating time using the temperature data. The controller 210 can compare temperature readings from the different sensors 260 to determine the actual starting hot water reserve. For example, if $T_{30}$ and $T_{BOTTOM}$ are both approximately equal to the inlet water temperature, and $T_{20}$, $T_{10}$ and $T_{TOP}$ are approximately equal to the setpoint temperature, then the controller 210 can infer that the tank 102 has 20 gallons of hot water reserve (although the actual reserve may be between 20 and 30 gallons). If the desired reserve capacity, on the other hand, is 10 gallons, then the controller 210 can adjust the required units of operating time downward accordingly. Furthermore, the controller 210 can use the actual reserve, as indicated by the temperature sensors 260, in the calculations of step 1140.

On the other hand, if the current reserve as indicated by the temperature sensors 260 is less than the desired reserve capacity (for example, 10 gallons is indicated by the temperature sensors but the desired reserve capacity is 20 gallons), then the controller 210 can adjust the required units of operating time upward accordingly. The controller 210 can also, in such circumstances, adjust the selection criteria in step 1150, since none of the n heating profiles will have a minimum reserve that meets or exceeds the desired reserve capacity.

By operating the water heater 100 as described above, the cost to the user can be decreased in accordance with the user's tolerance for the risk of running out of hot water. If the water heater 100 were to be operated in the traditional manner, the heating source 300 and pump 104 would be activated whenever there is a hot water draw, and would deactivate only when the tank 102 is filled with hot water. The calculated daily cost of such operation (using the electricity price 700 and the usage profile 500) would be $1.24 per day, or $453 over the course of a year. In contrast, by setting the desired reserve capacity to 20 gallons, the operating costs drops by 13%, to $1.08/day or $393/year. Further savings are achieved by reducing the desired reserve capacity. At 10 gallons of desired reserve capacity the operating cost drops to $0.95/day or $349/year, and with no reserve capacity the operating cost drops to $0.85/day or $311 per year.

The controller 210 can be further configured to adjust the desired reserve capacity based on the cost savings or the operating cost. For example, a user of the water heater 100 can input, via the user interface 220, a desired cost savings over the traditional operation that is to be realized, and the controller 210 can determine the desired reserve capacity based on that cost savings. Alternatively, the user can instruct the controller 210 to default to traditional operation unless operating with the selected desired reserve capacity provides at least a threshold cost savings. The controller 210 can also be configured to track the cost savings realized by the operation of the water heater 100, and to provide that information to the user via the user interface 220.

The controller 210 can additionally or alternatively be configured to allow for various minimum reserve capacities to be set during the time period. By way of example, it may be desirable to have a first minimum reserve capacity during certain hours, and one or more different reserve capacities during other hours. By way of example, a minimum reserve capacity of 30 gallons may be desired during the evening hours (e.g. 5 pm to 9 pm) but a lower minimum reserve capacity of 10 gallons may be acceptable during morning hours (e.g. 6 am to 9 am) and zero reserve capacity may be acceptable during the overnight hours. The operating profile can be further optimized to produce a lower operating cost based on such varying minimum reserve capacities.

Various alternatives to the certain features and elements of the present invention are described with reference to specific embodiments of the present invention. With the exception of features, elements, and manners of operation that are mutually exclusive of, or are inconsistent with, each embodiment described above, it should be noted that the alternative features, elements, and manners of operation described with reference to one particular embodiment are applicable to the other embodiments. The embodiments described above and illustrated in the figures are presented by way of example only and are not intended as a limitation upon the concepts and principles of the present invention. It will be appreciated by one having ordinary skill in the art that various changes in the elements and their configuration and arrangement are possible without departing from the spirit and scope of the present invention.

What is claimed is:

1. A method of operating a water heater, comprising:

determining a predicted variation of a first variable over a future time period, the first variable relating to hot water consumption rate;

calculating a total required operating time of the water heater over the future time period using the predicted variation of the first variable;

determining a plurality of possible operating profiles over the future time period, each one of the possible operating profiles providing a total operating time that is equal to the total required operating time;

calculating a minimum hot water reserve over the future time period for each one of the plurality of possible operating profiles, using the predicted variation of the first variable;

selecting one of the plurality of possible operating profiles based at least partially on the calculated minimum hot water reserve of said one of the plurality of possible operating profiles not being less than a predetermined desired reserve capacity; and operating the water heater over the future time period according to the selected one of the plurality of possible operating profiles.

2. The method of claim 1, wherein the future time period is a twenty-four hour period.

3. The method of claim 1, wherein the predicted variation of the first variable is based on historical variation of the first variable.

4. The method of claim 1, wherein the predicted variation of the first variable is based on information provided by a user of the water heater.

5. The method of claim 1, wherein the first variable is a volumetric flow rate of hot water demand.

6. The method of claim 1, wherein the predetermined desired reserve capacity is based at least partially on input provided by a user of the water heater.

7. The method of claim 6, wherein the predetermined desired reserve capacity is selected by the user from a plurality of selectable reserve capacities.

8. The method of claim 1, further comprising:

receiving a forecasted variation of a second variable over the future time period, the second variable relating to a cost of operating the water heater; and calculating a total cost of operating the water heater over the future time period for at least some of the plurality of possible operating profiles, using the forecasted variation of the second variable;

wherein selecting one of the plurality of possible operating profiles is based at least partially on the calculated total cost of operating the water heater over the future time period.

9. The method of claim 8, wherein the second variable is an electrical power price.

10. The method of claim 8, wherein selecting one of the plurality of possible operating profiles comprises:

determining which ones of the plurality of possible operating profiles have a calculated minimum hot water reserve that is not less than the predetermined desired reserve capacity, those ones forming a subset of the plurality of possible operating profiles; and selecting from said subset the operating profile having the lowest calculated total cost of operating the water heater over the future time period.

11. The method of claim 1, wherein operating the water heater comprises circulating water from a water tank at a first temperature through a heating source, heating the water to a second temperature using the heating source, and returning the heated water back to the water tank.

12. The method of claim 1, wherein operating the water heater comprises operating a heat pump system to heat water.

13. The method of claim 1, further comprising:

monitoring one or more characteristics of the water heater during the future time period; and adjusting the selected operating profile in response to the one or more characteristics.

* * * * *